US005819957A

United States Patent [19]

Hahn

[11] Patent Number: 5,819,957

[45] Date of Patent: Oct. 13, 1998

[54] POINT OF SALE EYEGLASS DISPLAY FIXTURE

[75] Inventor: Herbert Barton Hahn, Marietta, Ga.

[73] Assignee: Gold Medal Fixture Company, Jonesboro, Ga.

[21] Appl. No.: 805,505

[22] Filed: Feb. 26, 1997

[51] Int. Cl.[6] ..... A47F 7/00

[52] U.S. Cl. ..... 211/85.1; 211/90.01; 211/106; 248/902; 248/220.31

[58] Field of Search ..... 211/85.1, 57.1, 211/59.1, 106, 90.01; 248/902, 220.31, 220.41, 221.11, 223.41

[56] References Cited

U.S. PATENT DOCUMENTS

| | | | |
|---|---|---|---|
| D. 244,733 | 6/1977 | Tamara . | |
| D. 245,956 | 10/1977 | Dunchock . | |
| D. 250,438 | 12/1978 | Loiacono . | |
| D. 257,497 | 11/1980 | Franklin et al. . | |
| D. 258,099 | 2/1981 | Franklin et al. . | |
| D. 262,754 | 1/1982 | Merl . | |
| D. 264,025 | 4/1982 | Franklin et al. . | |
| D. 283,280 | 4/1986 | Maynard et al. . | |
| D. 312,538 | 12/1990 | Kopin . | |
| D. 321,445 | 11/1991 | Khantzis . | |
| D. 322,902 | 1/1992 | Khantzis . | |
| D. 345,097 | 3/1994 | Triangolo . | |
| D. 358,319 | 5/1995 | Porcaro et al. . | |
| D. 369,039 | 4/1996 | Guccione . | |
| D. 373,949 | 9/1996 | Eldon, III et al. . | |
| D. 374,366 | 10/1996 | Eldon, III et al. . | |
| D. 374,786 | 10/1996 | Liebers . | |
| 3,195,731 | 7/1965 | Bomar | 211/85.1 |
| 3,306,564 | 2/1967 | Nickel | 248/220.31 |
| 3,836,007 | 9/1974 | Rosenwein . | |
| 3,858,726 | 1/1975 | Rosenwein . | |
| 3,924,750 | 12/1975 | Dunchock . | |
| 4,502,602 | 3/1985 | Swanson . | |
| 4,558,788 | 12/1985 | Grothaus . | |
| 4,609,975 | 9/1986 | Badolato et al. . | |
| 4,671,416 | 6/1987 | Sorensen . | |
| 4,805,861 | 2/1989 | Thalenfeld et al. | 211/57.1 X |
| 5,011,027 | 4/1991 | Van Slett . | |
| 5,085,388 | 2/1992 | Creutz | 248/902 X |
| 5,100,006 | 3/1992 | Forrester . | |
| 5,144,345 | 9/1992 | Nyman . | |
| 5,260,726 | 11/1993 | Nyman . | |
| 5,316,252 | 5/1994 | Charnow et al. . | |
| 5,340,074 | 8/1994 | Porcaro et al. . | |
| 5,521,911 | 5/1996 | Nyman . | |
| 5,582,301 | 12/1996 | Josephson . | |
| 5,593,045 | 1/1997 | Eldon, III et al. . | |

FOREIGN PATENT DOCUMENTS

| | | | |
|---|---|---|---|
| 682795 | 11/1993 | Switzerland | 21/85.1 |

*Primary Examiner*—Robert W. Gibson, Jr.
*Attorney, Agent, or Firm*—Sanford J. Asman

[57] ABSTRACT

An improved display fixture having removable retaining arms is provided. The fixture allows the user to quickly and easily replenish the fixture with display items, such as eyeglasses, while also providing the user with the ability to readily alter the location of items on the fixture. The display fixture is provided with retaining arms which are compatible with the desired display merchandise. The retaining arms are readily removable from and replaceable on the display fixture in user desired locations. In accordance with the invention, the retaining arms have at least one leg which is fitted into an opening formed in a medium density fiberboard backboard. In one embodiment of the invention, the retaining arms include two legs and the backboard includes pairs of holes having a spacing which coincides with the leg spacing of the arms, while in another embodiment of the invention, the retaining arm only includes a single leg, which, together with a cross member is fitted into openings formed on the backboard to both securely hold the retaining arm while also preventing it from rotating on the backboard. The second embodiment of the invention has been found to be particularly well suited for use with powder coatings, as the hole tolerance is considerably relaxed when compared to the first embodiment.

19 Claims, 11 Drawing Sheets

POINT OF SALE EYEGLASS DISPLAY FIXTURE

FIELD OF THE INVENTION

The present invention relates generally to point of sale displays. In particular the invention relates to a point of sale display which is particularly suitable for use in displaying eyeglass frames.

BACKGROUND OF THE INVENTION

It has become quite common to have so-called "vision centers," either as stand alone locations, or as a part of a department store or other retail outlet. In such vision centers, or in other locations at which eyeglasses are sold, it is quite common to display eyeglass frames so that customers may readily see what is available and so that they may browse prior to dealing with the sales personnel of the store. This provides the customer with the opportunity to see what is available, and it saves the time of the sales personnel.

In order to be able to provide the vision center personnel with the ability to configure the display fixtures to provide attractive displays, as well as the ability to be able to display both eyeglasses and sales literature, or other items, different types of eyeglass display fixtures have heretofore been known. In view of the desire to provide the user with the ability to readily reconfigure the eyeglass display fixture, heretofore such fixtures have been developed which use a perforated board into which arms are fitted for holding eyeglass frames. A problem with the display fixtures known heretofore is that they were difficult to design in a manner which provided for them to be readily reconfigurable while at the same time having them be easy to use and attractive.

SUMMARY OF THE INVENTION

In accordance with the present invention, an attractive, and versatile point of sale fixture, which is particularly suitable for the display of eyeglass frames is described. The point of sale fixture is comprised of a perforated board which has a series of regularly spaced holes formed therein. The fixture further comprises at least one retaining arm having a configuration which is adapted to be fitted into the perforated board at user selected locations whereby retaining arms can be affixed to the perforated board in configurations which are suited to display eyeglasses or other items selected by the user of the fixture.

In order to provide for an attractive display fixture which can be used for the display of eyeglass frames, or for the display of point of sale literature or signage, the present invention makes use of a display fixture which is comprised of a board having a plurality of holes formed therein. In addition, the point of sale display fixture includes a series of retaining arms which are configured to hold either eyeglass frames, signage, or shelves. Thus, the same point of sale display fixture can be used for displaying both merchandise and display information, without limiting the user to any particular, predefined configuration.

DETAILED DESCRIPTION OF THE PREFERRED EMBODIMENT OF THE INVENTION

Figure 1:
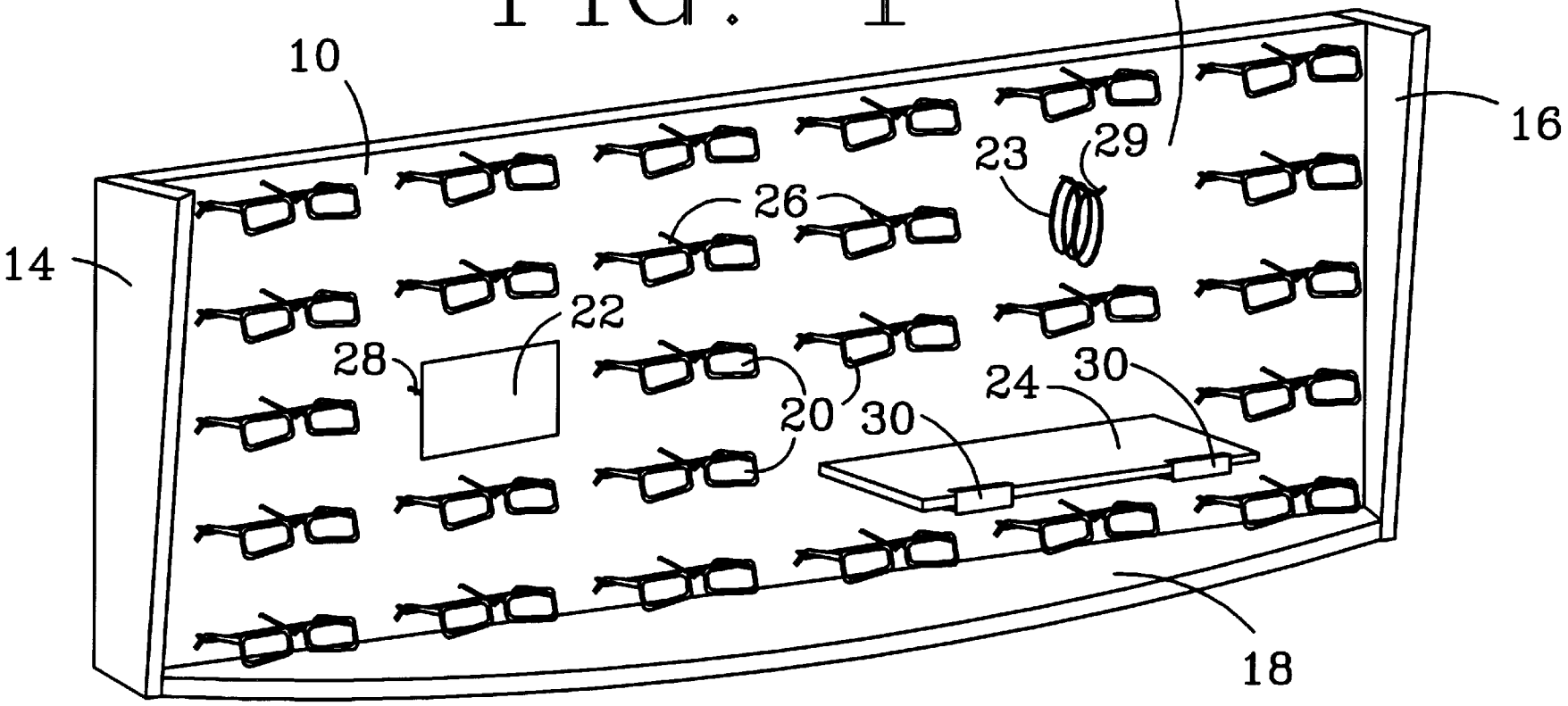
FIG. 1 is a perspective view of the display fixture of the present invention.

Referring now to the drawing in which like numerals indicate like parts throughout the several views, FIG. 1 illustrates the point of sale display fixture 10 of the present invention. As shown, the point of sale display fixture 10 is comprised of a backboard 12, which may optionally include side boards 14, 16, and a bottom shelf 18. The point of sale display fixture 10 of the present invention is particularly adapted to hold and display eyeglass frames 20, although, as will be seen, it can also be used to display point of sale information 22, general hanging merchandise items 23, or to securely hold shelves, such as a glass shelf 24.

In accordance with the present invention, there are a number of different types of retaining arms which are used to hold the eyeglass frames 20, point of sale information 22, general hanging merchandise, such as eyeglass retaining straps 23, and the shelf 24 on the display fixture 10. Thus, with continued reference to FIG. 1, the invention includes eyeglass retaining arms 26, a signage retaining arm 28, a generic retaining arm 29 for hanging general merchandise, and shelf retaining arms 30.

Figure 2:
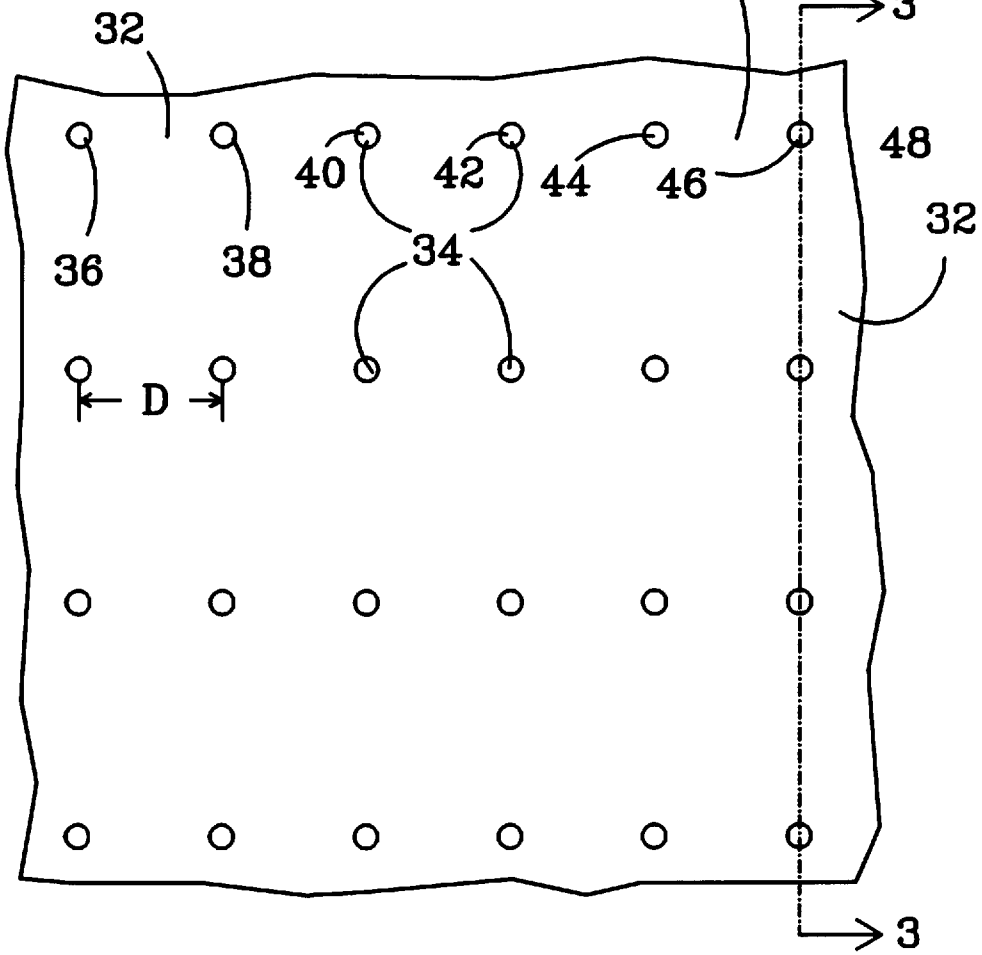
FIG. 2 is a front view of a portion of the backboard of a first embodiment of the display fixture shown in FIG. 1.

As described above, the present invention provides a point of sale display fixture 10 having a perforated backboard 12 made up of medium density fiberboard ("MDF"). As illustrated in FIG. 2, in a first embodiment of the invention, the medium density fiberboard is provided with a series of spaced holes 34. As will be described hereinafter, the spacing of the holes 34 in the backboard 12 is determined by the spacing of legs which are formed on the legs of retaining arms. In a first embodiment of the invention, the spacing of the holes 34 on the backboard 12 is selected so that there are pairs of holes, e.g. pair 36, 38, or pair 40, 42, or pair 44, 46, which have a predefined spacing which is consistent with the predefined spacing on the legs of the arm units designed to work with this embodiment, as will be explained hereinafter. Thus, in the first preferred embodiment of the invention, there are pairs of holes e.g., pair 36, 38, which are substantially horizontally aligned, and which have a center-to-center spacing, D. In the embodiment illustrated in FIG. 2, D is approximately three-quarters of an inch. While it is possible for each of the holes 34 along any horizontal row to have a three-quarter inch center-to-center spacing, it is only necessary for pairs of holes, e.g., pair 36, 38, to have such spacing. Thus, it is within the scope of the invention to have horizontally spaced holes wherein each hole is set at a spacing D from each other hole. It is also within the scope of the present invention to have holes 34 which have center-to-center spacings which are greater than or less than D, so long as there are pairs of holes 34 which have a center-to-center spacing of D. Thus, if D is three-quarters of an inch, then holes can have one-quarter inch or three-eighths of an inch center-to-center spacing. Alternatively, pairs of holes, having a spacing D therebetween, may be separated by several inches from other pairs of holes having a spacing D therebetween. In addition to having holes 34 formed along horizontal rows, in the preferred embodiment of the invention, holes 34 are also formed in substantially vertical columns whereby several rows and columns of eyeglass frames 20 or other items can be provided on the display fixture 10, as illustrated in FIG. 1. As will be understood by those skilled in the art, the provision of three-quarter inch center to center spacing on the backboard 12 is merely a design selection and should not be considered to be a required element of the preferred invention, as will become more clear after the retaining arms have been more fully described.

Figure 3:
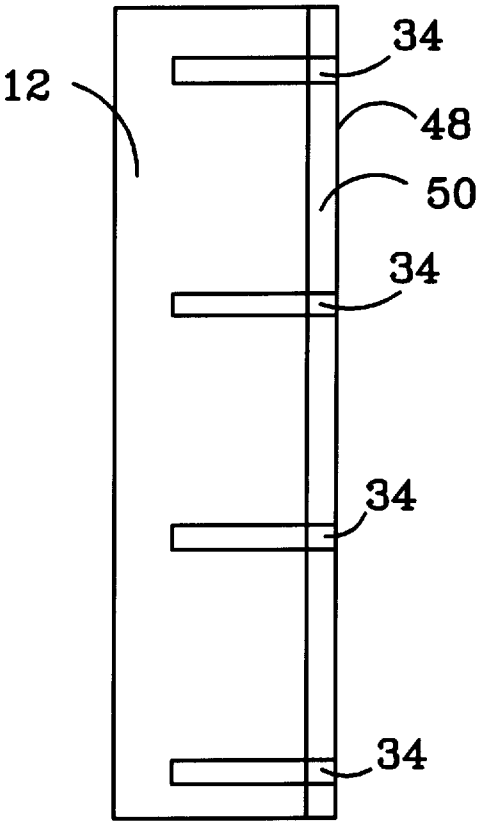
FIG. 3 is a cross-sectional view of the portion of the backboard shown in FIG. 2 taken along the lines 3—3 of FIG. 2.

Referring now to FIG. 3, a cross-sectional side view of a portion of the backboard 12 of FIG. 2 (taken along the line 3—3 of FIG. 2) is shown. As illustrated, the backboard 12 has a front surface 48 into which the holes 34 are drilled, as described above. In the first preferred embodiment of the invention, the holes 34 have diameters of approximately nine millimeters and they extend approximately ⅝" into the backboard 12, as illustrated. As will be understood by those skilled in the art, in a manufacturing procedure of the type needed to manufacture backboards 12, the drilling of the holes 34 may be accomplished by any suitable apparatus. In the preferred embodiment of the invention, it has been found that holes can be drilled in the backboard 12 with great accuracy by using computer numeric control ("CNC") machinery. With continued reference to FIG. 3, in the preferred embodiment of the invention, the surface of the backboard is preferably covered with a decorative plastic laminate material 48. Such laminate material 48 is provided by a number of companies. Examples of such laminate material are those sold under the trademarks WILSONART and FORMICA. Thus, in accordance with the preferred embodiment of the preferred invention, the holes 34 are formed in the backboard 12 after the backboard 12 has been laminated.

Figure 4:
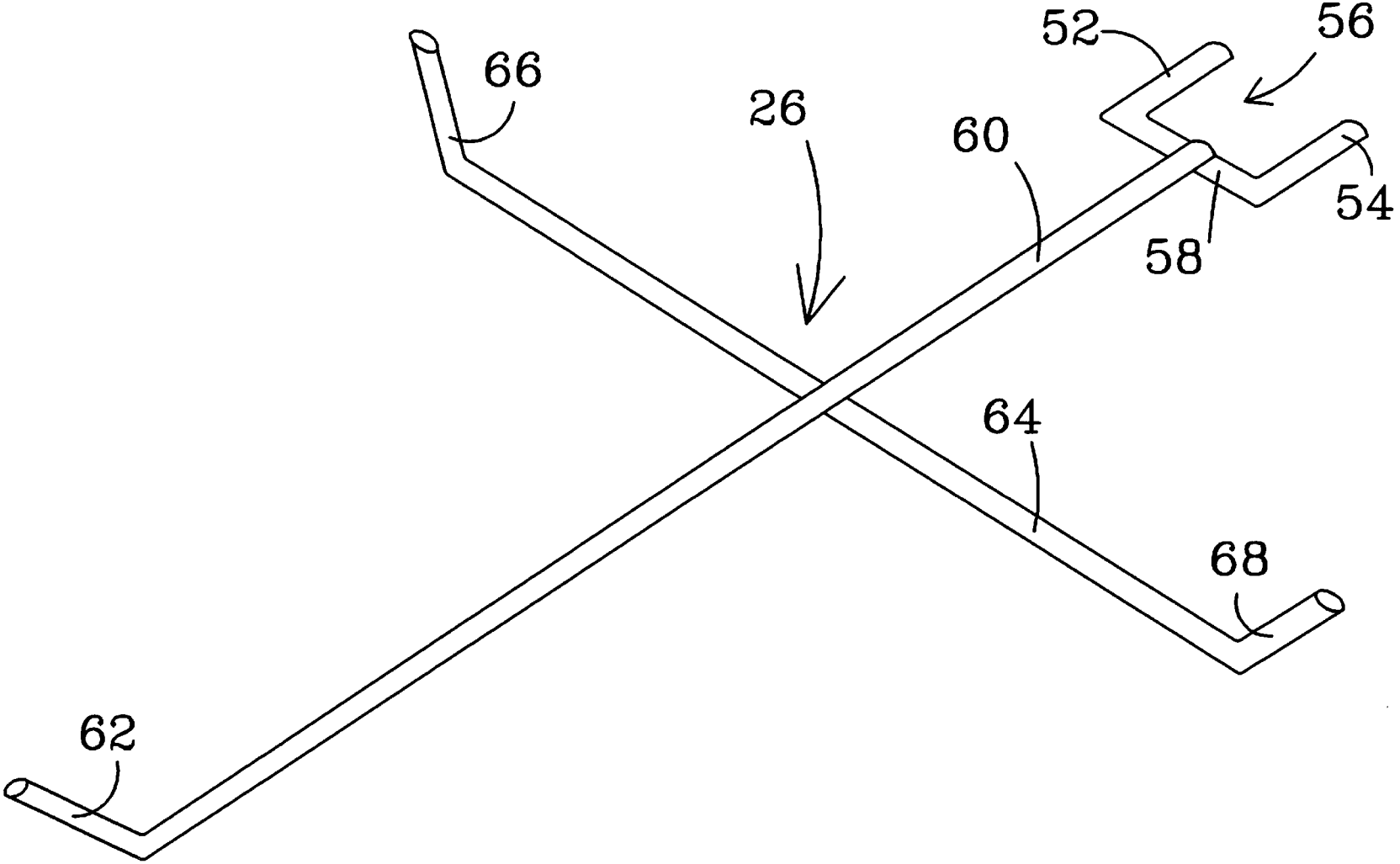
FIG. 4 is a perspective view of first embodiment of an eyeglass retaining arm of type used with the first embodiment of the present invention.

Referring now to FIG. 4, a first eyeglass retaining arm 26 in accordance with the first embodiment of the invention, is shown. The eyeglass retaining arm 26 is used for holding eyeglass frames 20, as illustrated in FIG. 1. The eyeglass retaining arm 26 includes a pair of legs 52, 54 which are a part of a substantially U-shaped leg member 56 which is formed of a single piece of nine millimeter wire in the preferred embodiment of the invention. Accordingly, the legs 52, 54 are joined by a central portion 58 to form the leg member 56. An elongated arm 60 extends forward from the central portion 58 of the leg member 56. The elongated arm 60 includes an upwardly bent portion 62 at the front end, which is the end remote from the leg member 56. In accordance with the preferred embodiment of the invention, the elongated arm 60 is welded to the central portion 58 of the leg member 56. A cross member 64 is welded to the elongated arm 60. The cross member 64 has a pair of upwardly bent end portions 66, 68 on either end thereof. In the preferred embodiment of the invention, the cross member is preferably formed of 9 mm wire which is preferably welded to the elongated arm 60 where the arm 60 intersects the cross member 64. Accordingly, with reference to FIG. 1, eyeglass frames 20 may be placed over the eyeglass retaining arm 26 with the arms of the eyeglass frames 20 hanging over, and supported by, the cross member 64, while the nose portion of the eyeglass frame 20 extends over the front portion of the elongated arm 60. The upwardly bent portion 62 prevents the eyeglass frame 20 from slipping off the retaining arm 26.

Figure 5:
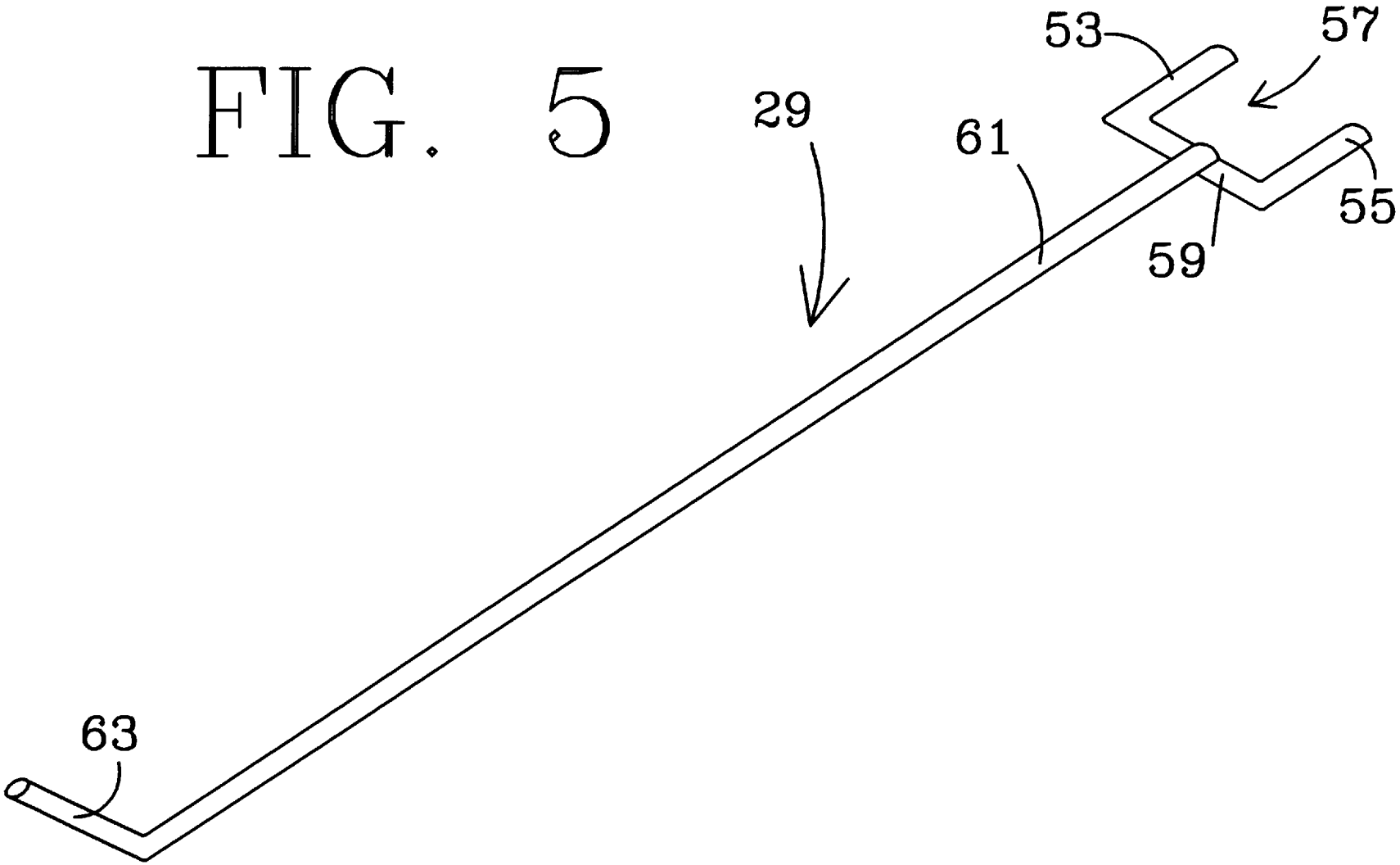
FIG. 5 is a perspective view of first embodiment of a generic retaining arm of the type used with the first embodiment of the present invention for hanging general merchandise.

Referring to FIG. 5, a generic retaining arm 29 used for hanging general merchandise in accordance with the first embodiment of the invention, is shown. The generic retaining arm 29 is quite similar to the eyeglass retaining arm 26, except that the generic retaining arm 29 has no cross member, as it is used to hold general hanging merchandise, such as the eyeglass retaining straps 23, illustrated in FIG. 1. The generic retaining arm 29 can also be used to hold items which are sealed on cardboard cards which have a hole formed in them, as will be understood by those skilled in the art. The generic retaining arm 29 includes a pair of legs 53, 55 which are a part of a substantially U-shaped leg member 57 which is formed of a single piece of nine millimeter wire in the preferred embodiment of the invention. Accordingly, the legs 53, 55 are joined by a central portion 59 to form the leg member 57. An elongated arm 61 extends forward from the central portion 59 of the leg member 57. The elongated arm 61 preferably includes an upwardly bent portion 63 at the front end, which is the end remote from the leg member 57. In accordance with the preferred embodiment of the invention, the elongated arm 61 is welded to the central portion 59 of the leg member 57, both of which are preferably formed of 9 mm wire. Accordingly, with reference to FIG. 1, merchandise items 23 may be placed over the generic retaining arm 29. The upwardly bent portion 63 prevents the merchandise items 23 from slipping off the generic retaining arm 29.

Figure 6:
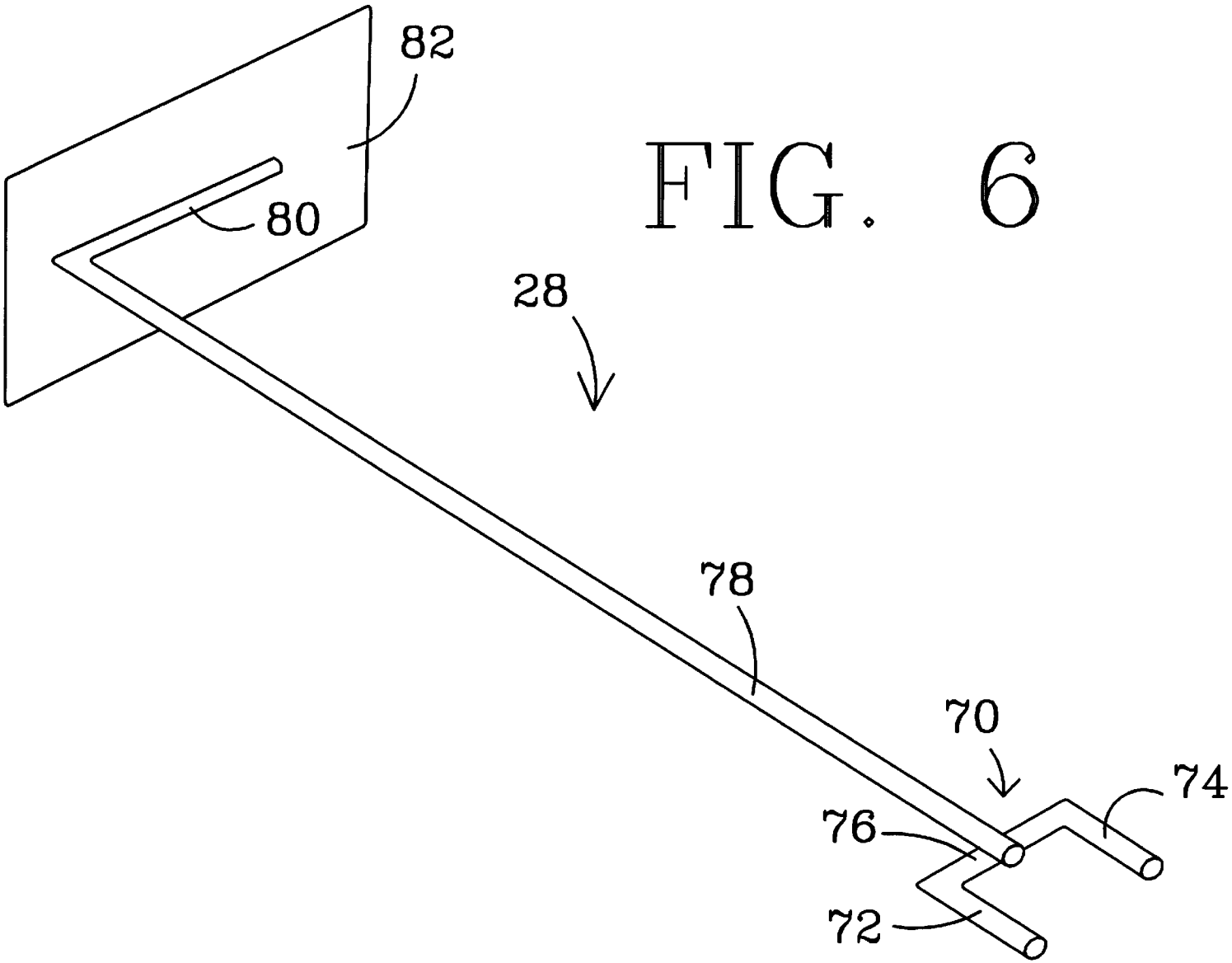
FIG. 6 is a perspective view of a first embodiment of a signage retaining arm of the type used in the first embodiment of the present invention.

Referring now to FIG. 6, a signage retaining arm 28 in accordance with the first embodiment of the invention is shown. The signage retaining arm 28 includes a leg member 70 which is substantially the same as the leg member 56 of the eyeglass retaining arm 26 of FIG. 4. Accordingly, the leg member 70 includes a pair of legs 72, 74 which are joined by a central member 76 to which an elongated arm 78 is attached. With respect to the signage retaining arm 28, the elongated arm 78 has a substantially L-shape, whereby there is a bent portion 80 which is shown to be at the front end of the elongated arm 78. A substantially rectangular signage retaining plate 82 is affixed to the arm 80, preferably by welding. When the signage retaining arm 28 is affixed to the backboard 12, suitable displays or signs may be affixed to a front surface of the plate 82 as shown in FIG. 1 at 22.

Figure 7:
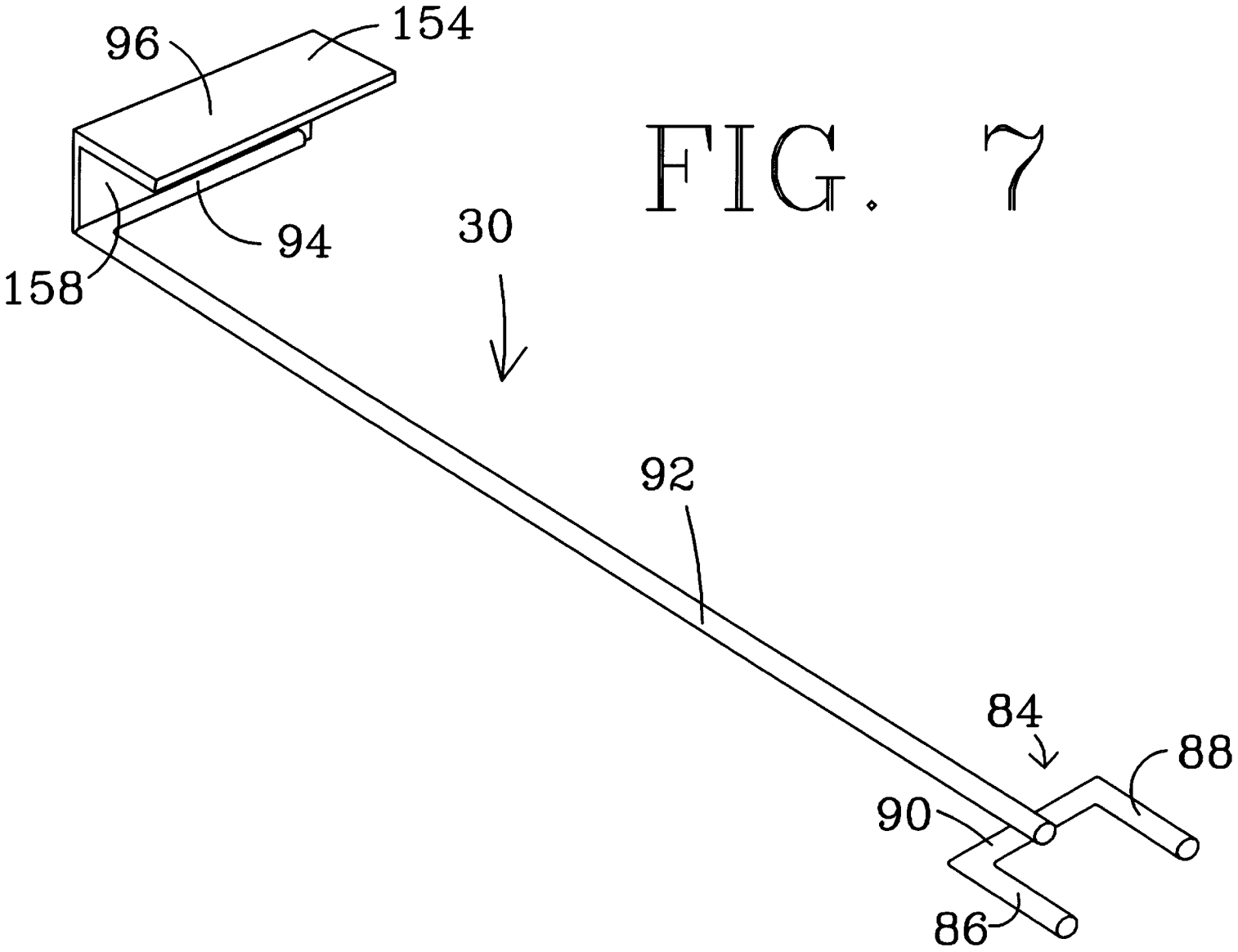
FIG. 7 is a perspective view of a first embodiment of shelf retaining arm of the type used with the first embodiment of the present invention.

Referring now to FIG. 7, a first embodiment of a shelf retaining arm 30 is shown. The shelf retaining arm 30 includes a leg member 84 having a pair of legs 86, 88 which are joined by a central portion 90 to which an elongated arm 92 is welded, as illustrated. The elongated arm 92 is substantially L-shaped, having a front leg portion 94 to which a shelf retaining bracket 96 having a substantially L-shaped cross-section is affixed, preferably by welding. As illustrated in FIG. 1, a pair of shelf retaining arms 30 may be used to support a shelf, such as the glass shelf 24 shown in FIG. 1. Preferably, each shelf will be supported by two or more shelf retaining arms 30.

While the first embodiment of the present invention illustrated in FIGS. 1–7 provides a very flexible fixture which permits the user to readily modify the display as shown in FIG. 1, it is often desirable to be able to provide retaining arms, such as the arms 26, 28, 30 in a variety of colors and finishes. It has been found that while it is quite easy to control the sizing and spacing of the holes 34 in the backboard 12, as illustrated in FIGS. 2 and 3, where there is a desire to provide powder coated retaining arms 26, 28, 29, 30 in which a paint powder is electrostatically affixed to the arms and then baked on to provide a very hard, smooth, finish, in a variety of colors, the powder painting process makes it very hard to maintain close tolerances on the size of the metal retaining arms. In particular, it has been found that while the holes may be drilled to tolerances on the order of one-thousandth of an inch (1 mil), a powder coated metal retaining arm will often have tolerances on the order of one-tenth of an inch. Accordingly, it has been found that while the fixture display system of the first embodiment works quite well and provides the flexibility which is desired to the end user, when the retaining arms are powder coated, it may be difficult to provide tolerances which make it easy to insert a retaining arm into the backboard while simultaneously insuring that there is a good solid fit which will not work loose. This is particularly true with respect to the shelf retaining arms 30 made in accordance with the first embodiment of the invention. In order to solve that problem, and to provide a second embodiment of the present invention in which powder coated metal retaining arms can be readily used, an alternative embodiment of the backboard 12 is illustrated in FIG. 8 as 100.

Figure 9:
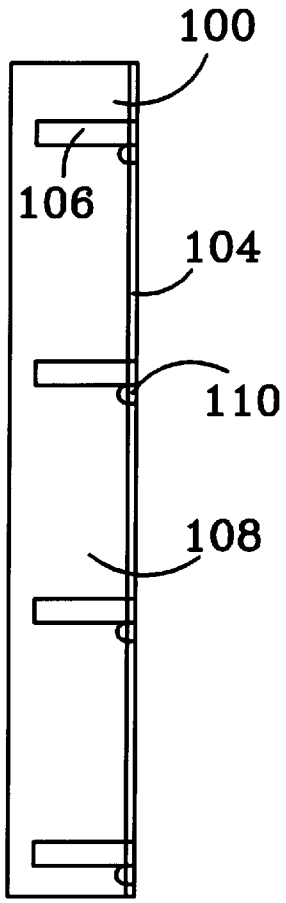
FIG. 9 is a cross-sectional view of the backboard shown in FIG. 8 taken along the lines 9—9 of FIG. 8.
Figure 8:
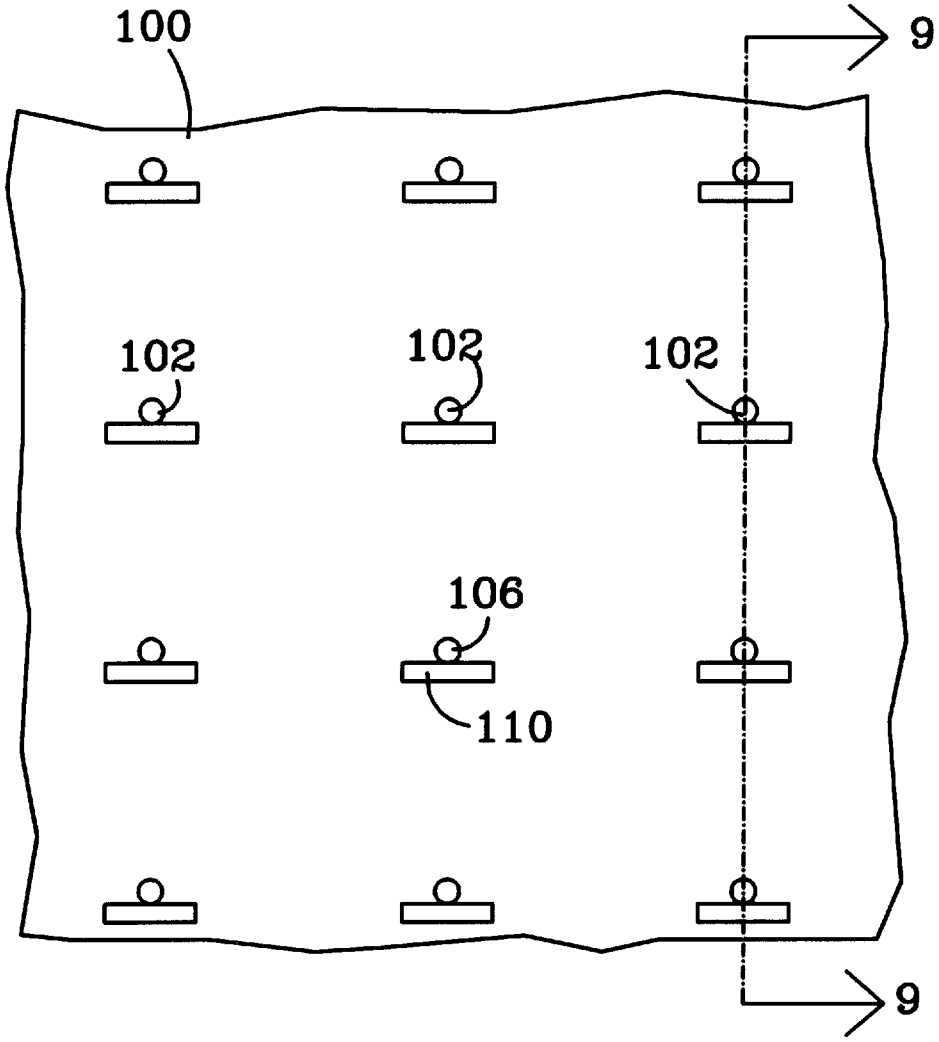
FIG. 8 is a front view of an alternative embodiment of a backboard for use with a second embodiment of the present invention.

Referring to FIGS. 8 and 9, in the second embodiment of the invention the backboard 100 includes a series of openings 102 which are formed at spaced intervals, in both horizontal rows and vertical columns, as shown. The openings 102 are formed in a manner somewhat different than the holes 34, as will be explained with reference to FIGS. 8 and 9 (where FIG. 9 is a cross-sectional view of a portion of FIG. 8 taken along the line 9—9 of FIG. 8). The backboard 100 of the second embodiment of the invention also preferably includes a laminated surface 104 comprised of a plastic laminate. Each of the openings 102 is comprised of both a circular hole 106, which extends about five-eighths of an inch into the medium density fiberboard 108 and an elongated opening 110 which extends about nine millimeters into the surface of the backboard 100. Accordingly, as illustrated in FIGS. 8 and 9, the backboard 100 of the second embodiment of the invention is designed to receive a series of retaining arms having a somewhat different configuration than the retaining arms of the first embodiment of the invention which were discussed with reference to FIGS. 4–7.

Figure 10:
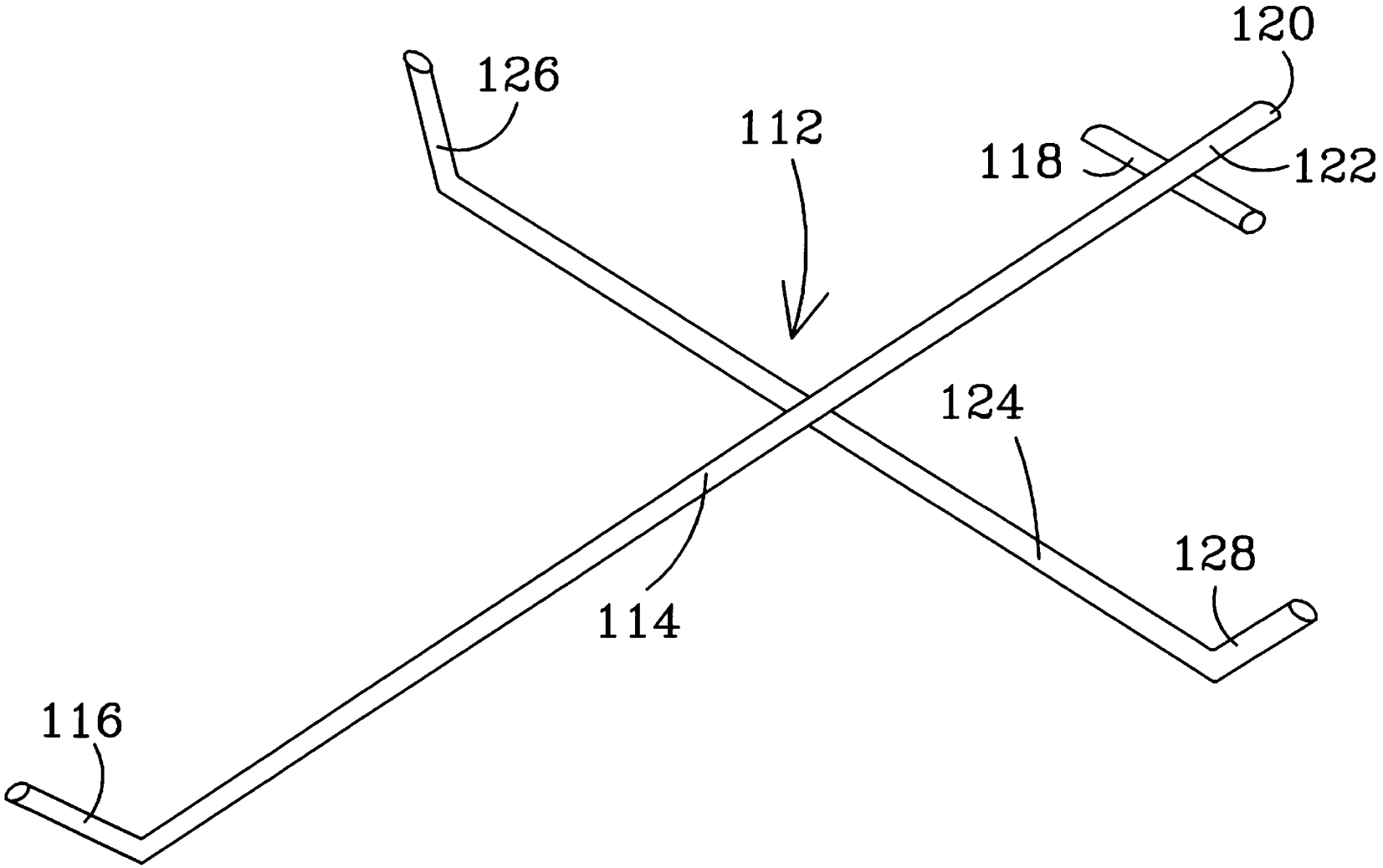
FIG. 10 is a perspective view of a second embodiment of an eyeglass retaining arm of the type used with the backboard illustrated in FIGS. 8 and 9.

Referring now to FIG. 10, an eyeglass retaining arm 112 comprises an elongated arm 114 having an upwardly bent front portion 116. A cross member 118 is welded to the rear portion of the elongated arm 114. In accordance with the present invention, the portion 122 of the elongated arm 114 which extends between the distal end 120 and the cross member 118 of the elongated arm 114 has a length which is somewhat shorter than the depth of the holes 106. The eyeglass retaining arm 112 further comprises a cross member 124 having a pair of upwardly bent end portions 126, 128. The cross member 124 is welded to the elongated arm 114 as shown. The operation of the eyeglass retaining arm 112 is identical to the operation of the eyeglass retaining arm 26 of FIG. 4. However, with respect to the attachment of the eyeglass retaining arm 112 to the backboard 100, it is only necessary to place the distal end 120 into one of the holes 102 and to push the eyeglass retaining arm 112 into the backboard 100 until the cross member 118 is securely retained within the elongated slot 110, thereby preventing the eyeglass retaining arm 112 from rotating in the hole 106.

An advantage of the single leg construction of the eyeglass retaining arm 112 which has only a single leg portion 122 is that the stability of the eyeglass retaining arm 112 comes about as a result of the cross member 118 fitting within the elongated slot 110. Accordingly, the tolerances involved in the manufacture of the eyeglass retaining arm 112 and the openings 102 can be relaxed considerably with respect to that required with respect to the first embodiment of the invention. Thus, the display fixture made in accordance with the second embodiment of the invention can readily include powder coated retaining arms without concern about loose tolerances causing the retaining arms to be unstable when placed in the backboards.

Figure 11:
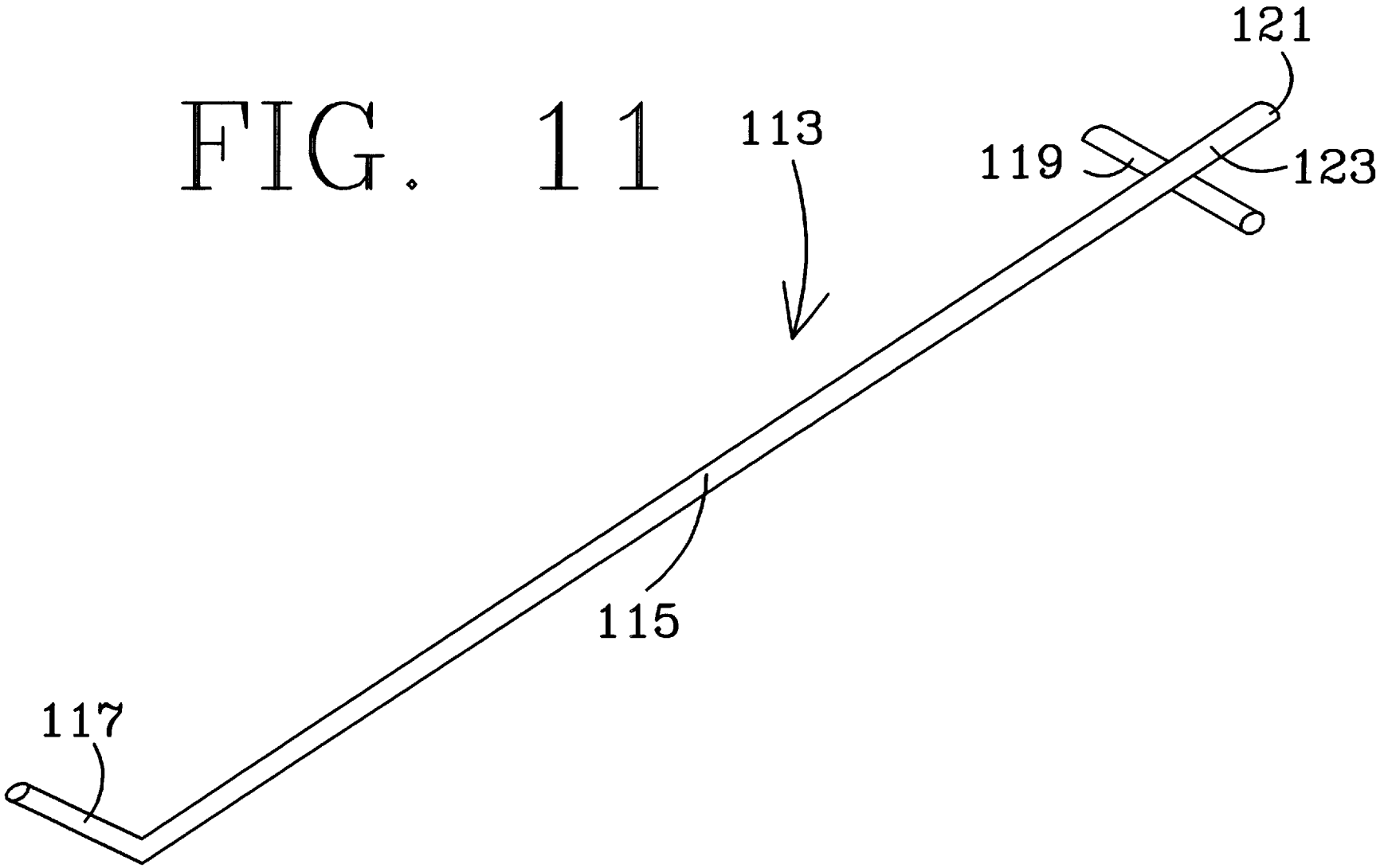
FIG. 11 is a perspective view of second embodiment of a generic retaining arm of the type used with the backboard illustrated in FIGS. 8 and 9.

With reference to FIG. 11, a generic retaining arm 113 for holding general merchandise is similar in construction to the eyeglass retaining arm 112. The generic retaining arm comprises an elongated arm 115 having an upwardly bent front portion 117. A cross member 119 is welded to the rear portion of the elongated arm 115. In accordance with the present invention, the portion 123 of the elongated arm 115 which extends between the distal end 121 and the cross member 119 of the elongated arm 115 has a length which is somewhat shorter than the depth of the holes 106. The operation of the generic retaining arm 113 is identical to the operation of the generic retaining arm 29 of FIG. 5. However, with respect to the attachment of the generic retaining arm 113 to the backboard 100, it is only necessary to place the distal end 121 into one of the holes 102 and to push the eyeglass retaining arm 113 into the backboard 100 until the cross member 119 is securely retained within the elongated slot 110, thereby preventing the generic retaining arm 113 from rotating in the hole 106.

Figure 12:
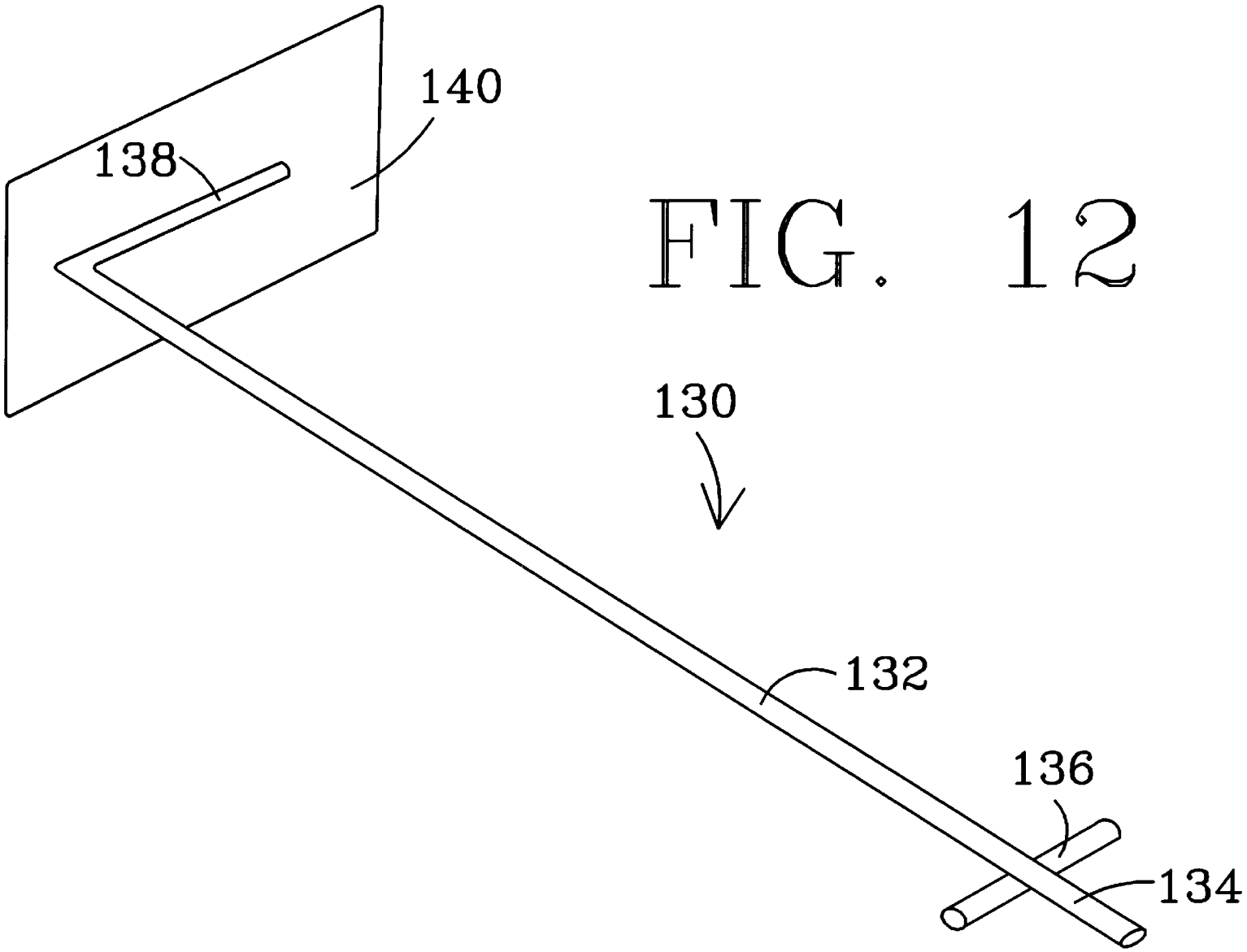
FIG. 12 is a second embodiment of a signage retaining arm of the type used with the backboard illustrated in FIGS. 8 and 9.

With reference to FIG. 12, a signage retaining arm 130 manufactured in accordance with the second embodiment of the invention includes an elongated arm 132 having a portion 134 which extends into the backboard. Affixed to the elongated arm is a cross member 136 which fits within one of the slots 110. The front portion of the signage retaining arm includes an L-shaped bent portion 138 to which a substantially rectangular signage retaining plate 140 is attached in a manner similar to the signage retaining arm 28 of FIG. 6.

Figure 13:
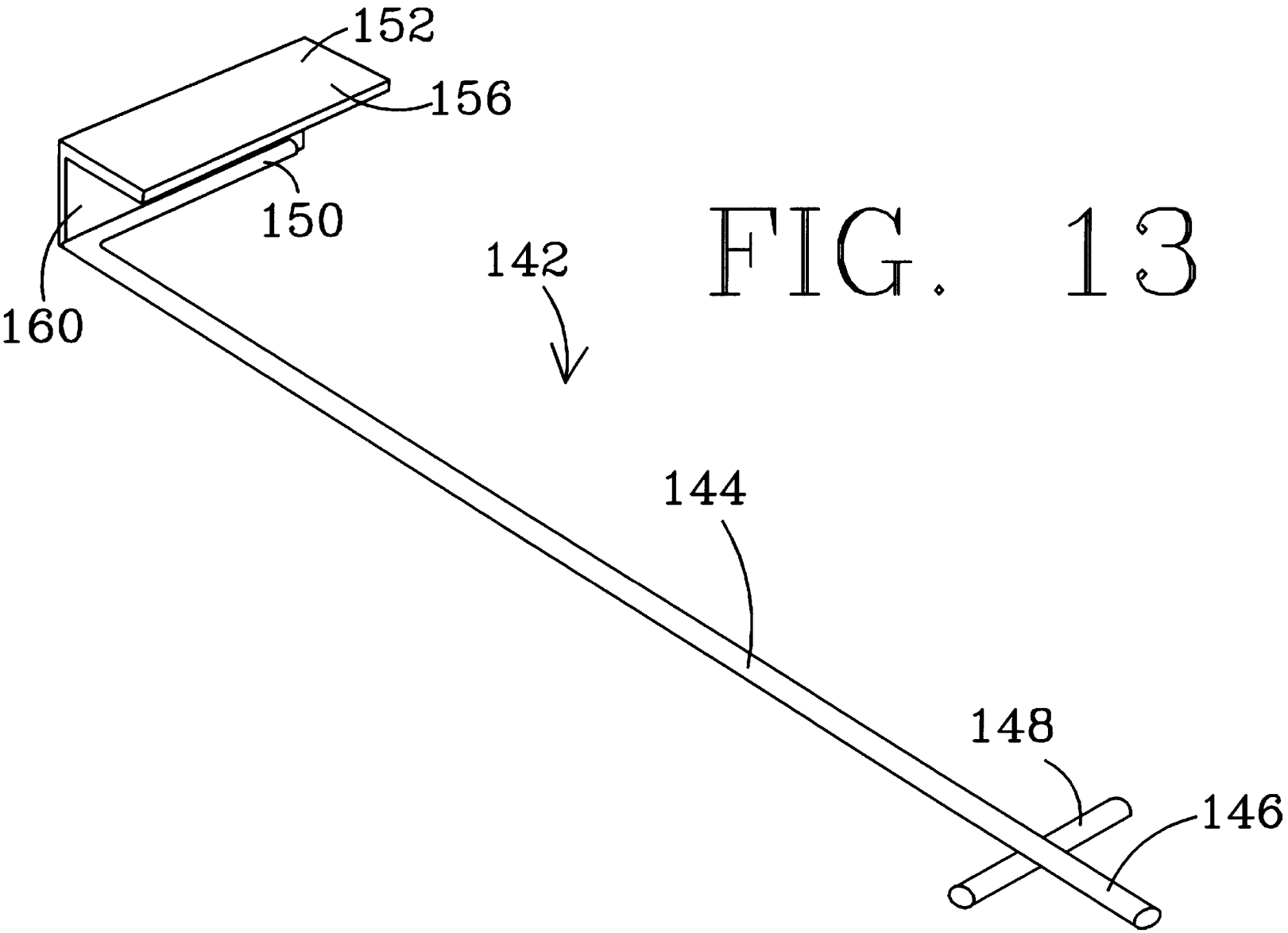
FIG. 13 is a perspective view of a second embodiment of a shelf retaining arm of the type used with the backboard illustrated in FIGS. 8 and 9.

With reference to FIG. 13, a shelf retaining member 142 manufactured in accordance with the second embodiment of the present invention is shown. The shelf retaining member 142 includes an elongated arm 144 having a distal portion 146 which extends into one of the holes 106 and a cross member 148 which will fit within one of the elongated slots 110 on the backboard 100. The front portion of the elongated arm 144 includes a bent portion 150 to which a shelf retaining bracket 152 having a substantially L-shaped cross-section is welded.

In accordance with the preferred embodiment of the present invention, the various retaining aims 26, 28, 29, 30,

112, 113, 130, 142, are made of bent wire rods having a nine gauge thickness. The signage retaining plates 82, 140 of the signage retaining arms 28, 130, respectively, are preferably made of 16 gauge material. As will be obvious to those skilled in the art, signage may be attached to the front portions of the signage plates 82, 140 as shown in FIG. 1, by any of a variety of means, including using double-faced tape or hook and loop fastening material which has been affixed to both the signage and to the front surfaces of the plates 82, 140.

The shelf retaining brackets 96, 152 of the shelf retaining arms 30, 142, respectively, are also preferably formed of 16 gauge material having top portions 154, 156, respectively, which extend from the front portion 158, 160, respectively, backward from the front portions 158, 160 by about one-half inch.

In use, the second embodiment of the present invention, illustrated in FIGS. 8–13, has been shown to provide a very flexible point of sale display fixture which can be made available in a variety of colors due to the availability of powder coating and which also provides a very secure fitting for the retaining arms 112, 113, 130, 142. Thus the display fixture 10 is quite flexible in that it allows the user to place retaining arms in virtually any desired locations on the backboard 100, while at the same time insuring that such retaining arms, together with the merchandise thereon, are securely retained, even when shelving is used.

We claim:

1. A point of sale eyeglass display fixture comprising:

(a) a backboard made of medium density fiberboard, said backboard having openings comprised of pairs of horizontally disposed holes which extend into said backboard, each of said pairs of holes having a center-to-center spacing of D; and (b) at least one retaining arm having a configuration which is adapted to retain an item on said backboard, said at least one retaining arm having at least one straight leg which may be fitted into at least one of said openings in said backboard, said at least one straight leg having a substantially uniform cross-section, said at least one retaining arm also including at least one additional leg for preventing said at least one retaining arm from rotating while it is affixed to said backboard, said at least one straight leg having a length which is approximately equal to the depth of said openings, each of said pair of legs being formed of a material which has a shape and size which is adapted to fit within corresponding ones of said pairs of horizontally disposed holes, said retaining arm being comprised of an elongated member having a proximal end and a distal end, there being a cross-member formed thereon between said proximal end and said distal end, said cross-member being substantially perpendicular to said elongated member, whereby said elongated member and said cross-member form a cross so that said retaining arm is able to support an eyeglass frame by placing the nose portion of the eyeglass frame over the proximal end of said elongated member while said arms of said eyeglass frame can be supported by either said elongated member or by said cross-member depending upon whether said arm members are either folded or extended, respectively.

2. The point of sale eyeglass display fixture of claim 1 wherein said retaining arm is comprised of an elongated member having a proximal end and a distal end, the proximal end of said elongated member having an L-shaped portion, a signage retaining plate being affixed to said L-shaped portion whereby signage can be displayed thereon when said retaining arm is affixed to said backboard.

3. The point of sale eyeglass display fixture of claim 1 wherein said medium density fiberboard is about three-quarters of an inch thick.

4. The point of sale eyeglass display fixture of claim 1 wherein each of said holes in said pairs of horizontally disposed holes has a depth of approximately five-eighths of an inch.

5. The point of sale eyeglass display fixture of claim 2 wherein said medium density fiberboard is about three-quarters of an inch thick.

6. The point of sale eyeglass display fixture of claim 2 wherein each of said holes in said pairs of horizontally disposed holes has a depth of approximately five-eighths of an inch.

7. A point of sale eyeglass display fixture comprising:

(a) a backboard made of medium density fiberboard, said backboard having openings comprised of pairs of horizontally disposed holes which extend into said backboard, each of said pairs of holes having a center-to-center spacing of D; and (b) at least one retaining arm having a configuration which is adapted to retain an item on said backboard, said at least one retaining arm having at least one straight leg which may be fitted into at least one of said openings in said backboard, said at least one straight leg having a substantially uniform cross-section, said at least one retaining arm also including at least one additional leg for preventing said at least one retaining arm from rotating while it is affixed to said backboard, said at least one straight leg having a length which is approximately equal to the depth of said openings, each of said pair of legs being formed of a material which has a shape and size which is adapted to fit within corresponding ones of said pairs of horizontally disposed holes, said retaining arm being comprised of an elongated member having a proximal end and a distal end, the proximal end of said elongated member having an L-shaped shelf retaining bracket affixed thereto, whereby said L-shaped shelf retaining bracket can be used in cooperation with said elongated arm to retain a shelf thereon.

8. The point of sale eyeglass display fixture of claim 7 wherein said medium density fiberboard is about three-quarters of an inch thick.

9. The point of sale eyeglass display fixture of claim 7 wherein each of said holes in said pairs of horizontally disposed holes has a depth of approximately five-eighths of an inch.

10. A point of sale eyeglass display fixture comprising:

(a) a backboard made of medium density fiberboard, said backboard having openings formed therein; and (b) at least one retaining arm having a configuration which is adapted to retain an item on said backboard, said at least one retaining arm having at least one straight leg which may be fitted into at least one of said openings in said backboard, said at least one straight leg having a substantially uniform cross-section, said at least one retaining arm also including at least one additional leg for preventing said at least one retaining arm from rotating while it is affixed to said backboard, said at least one straight leg having a length which is approximately equal to the depth of said openings, said at least one member for preventing said retaining arm from rotating while it is affixed to said backboard being comprised of a cross-member, said cross-member being formed at a first distance from the distal end of said elongated member, said openings in said backboard each including a hole for receiving said leg of said retaining arm and a cross-member receiving opening which is shaped to receive said cross-member, said hole having a depth which is at least equal to said first distance plus the thickness of said cross-member, whereby when said leg of said retaining arm is inserted into said hole, said cross-member can be inserted into said cross-member receiving opening thereby holding said retaining arm on said backboard and preventing said retaining arm from rotating.

11. The point of sale eyeglass display fixture of claim 10 wherein said retaining arm is comprised of an elongated member having a proximal end and a distal end, there being a second cross-member formed thereon between said proximal end and said distal end, said elongated member being substantially perpendicular to said elongated member, whereby said elongated member and second cross member form so that said retaining arm is able to support an eyeglass frame by placing the nose portion of the eyeglass frame over the proximal end of said elongated member while said arms of said eyeglass frame can be supported by either said elongated member or by said second cross-member depending upon whether said arm members are either folded or extended, respectively.

12. The point of sale eyeglass display fixture of claim 10 wherein said retaining arm is comprised of an elongated member having a proximal end and a distal end, the proximal end of said elongated member having an L-shaped portion, a signage retaining plate being affixed to said L-shaped portion whereby signage can be displayed thereon when said retaining arm is affixed to said backboard.

13. The point of sale eyeglass display fixture of claim 10 wherein said retaining arm is comprised of an elongated member having a proximal end and a distal end, the proximal end of said elongated member having an L-shaped shelf retaining bracket affixed thereto, whereby said L-shaped shelf retaining bracket can be used in cooperation with said elongated arm to retain a shelf thereon.

14. The point of sale eyeglass display fixture of claim 10 wherein said medium density fiberboard is about three-quarters of an inch thick.

15. The point of sale eyeglass display fixture of claim 10 wherein each of said holes in said pairs of horizontally disposed holes has a depth of approximately five-eighths of an inch.

16. The point of sale eyeglass display fixture of claim 11 wherein said medium density fiberboard is about three-quarters of an inch thick.

17. The point of sale eyeglass display fixture of claim 11 wherein each of said holes in said pairs of horizontally disposed holes has a depth of approximately five-eighths of an inch.

18. The point of sale eyeglass display fixture of claim 12 wherein said medium density fiberboard is about three-quarters of an inch thick.

19. The point of sale eyeglass display fixture of claim 12 wherein each of said holes in said pairs of horizontally disposed holes has a depth of approximately five-eighths of an inch.

* * * * *